US006745490B2

(12) United States Patent
Akimoto et al.

(10) Patent No.: US 6,745,490 B2
(45) Date of Patent: Jun. 8, 2004

(54) DISTRIBUTIVE EJECTION DEVICE FOR LIQUID MATERIAL TO BE USED IN FREEZE-DRYING APPARATUS FOR FOODSTUFFS, MEDICAMENTS, AND SO ON

(75) Inventors: Hiromichi Akimoto, Tokyo (JP); Ryoji Sunama, Tokyo (JP)

(73) Assignee: Kyowa Vacuum Engineering Co., Ltd., Tokyo (JP)

( * ) Notice: Subject to any disclaimer, the term of this patent is extended or adjusted under 35 U.S.C. 154(b) by 38 days.

(21) Appl. No.: 10/035,307

(22) Filed: Jan. 4, 2002

(65) Prior Publication Data

US 2002/0189126 A1 Dec. 19, 2002

(30) Foreign Application Priority Data

Jun. 14, 2001 (JP) ..... 2001-180716

(51) Int. Cl.[7] ..... F26B 5/06

(52) U.S. Cl. ..... 34/92; 34/284; 34/288; 34/290; 34/296; 34/297; 34/176; 34/179

(58) Field of Search ..... 62/347, 66, 67, 62/68, 69, 70, 71, 72; 34/92, 284, 285, 286, 287, 288, 290, 291, 294, 295, 296, 297, 298, 299, 300, 376, 380, 381, 384, 385, 386, 576, 578, 586, 80, 176, 179, 180, 181, 182, 183

(56) References Cited

U.S. PATENT DOCUMENTS 3,132,929 A * 5/1964 Thuse ..... 34/77
3,396,475 A * 8/1968 Scheibel ..... 34/5
3,427,816 A * 2/1969 Hanny et al. ..... 62/74
3,435,633 A * 4/1969 Dixon ..... 62/352
4,590,684 A * 5/1986 Arsem ..... 34/5
4,802,286 A * 2/1989 Kobayashi et al. ..... 34/15
5,090,132 A * 2/1992 Kobayashi et al. ..... 34/5
5,208,998 A * 5/1993 Oyler ..... 34/5

* cited by examiner

*Primary Examiner*—K. B Rinehart
(74) *Attorney, Agent, or Firm*—Browdy and Neimark, P.L.L.C.

(57) ABSTRACT

This invention is concerned with a distributive ejection apparatus for liquid material in a freeze-drying apparatus for foodstuffs, medicaments, etc., wherein the liquid material adjusted from the starting material for foodstuffs, medicaments, etc. is caused to freeze onto the inner wall surface of the upright cylindrical tube, and the distributive ejection of the liquid material onto the tube at the time of its freeze-drying by sublimation of the moisture content in the material under the vacuum condition may be done in the state of supplying the liquid material over the entire surface of the inner wall surface of the tube with a substantially uniform thickness.

A cylindrical wall a protruding upwardly of the jacket 2 for circulation of heat medium, provided on the outer periphery of the tube 1, is disposed on the upper end side of the upright cylindrical tube equipped on a freeze-drying apparatus w, in the form of extending the peripheral wall of the tube 1; then, onto this inner wall surface of this cylindrical wall, the liquid material is ejected from the distributive ejection nozzles 70 equipped on the downstream side of the tube passageway 5 for feeding the liquid material is sputtered, and the thus ejected liquid material is rendered uniform in the circumferential direction on and along the inner wall surface of the cylindrical wall a, and, while it flows down, in this state, on the inner surface of the cylindrical wall a, it is made to flow onto the inner wall surface 1*a* of the tube 1 which constitutes the freezing surface of the liquid material.

8 Claims, 6 Drawing Sheets

DISTRIBUTIVE EJECTION DEVICE FOR LIQUID MATERIAL TO BE USED IN FREEZE-DRYING APPARATUS FOR FOODSTUFFS, MEDICAMENTS, AND SO ON

BACKGROUND OF THE INVENTION

1) Field of the Invention

This invention is concerned with an improvement in the distributive ejection device for liquid material to be used in freeze-drying apparatus for foodstuffs, medicaments, and so on, the liquid material being prepared from those foodstuffs, medicaments and so on in their desiccated conditions; such liquid material being distributively ejected into the inner cavity of an upright cylindrical tube, followed by its freezing on the inner wall surface of the cylindrical tube; then sublimating the moisture (or water) content in the material by application of sublimation heat under the vacuum condition to obtain the freeze-dried product.

2) Description of Prior Arts

Conventional freeze-drying apparatus, in which the materials to be freeze-dried such as foodstuffs, medicaments, etc. are adjusted into a liquid form and kept frozen, after which it is desiccated by application of sublimation heat to the materials for desiccation, under the vacuum condition, to sublimate the moisture content in the material, has usually been done in such a manner that the materials to be desiccated are adjusted into a liquid form, then the liquid material is filled in a desiccating vessel such as trays, etc., each desiccating vessel being placed in a desiccating chamber of the freeze-drying apparatus provided with storing shelves, wherein these desiccating vessels are subjected to freezing to sublimate the water content in the liquid material by supplying the sublimation heat, within the drying chamber, to capture the water vapor from the liquid material as frozen by means of a vacuum exhaustion type cold-trap which is communicatively connected to the desiccating chamber.

As another expedient, there is one which has been developed by the applicants of the present invention. This expedient is of such a construction that, as shown in FIG. 1 of the accompanying drawing, the desiccating chamber of the freeze-drying apparatus is formed of a multitude of upright cylindrical tubes 1, 1, . . . to cause the liquid material to freeze on the inner wall surface thereof, which are arranged side by side in bundle at a predetermined space interval; then, a jacket 2 for circulating heat medium in and through each of these upright tubes is shaped in a bucket- or vessel-form and mounted on and around each of these bundled tubes; thereafter, an inlet tube 20 and an outlet tube 21 of this bucket- or vessel-shaped jacket 2 are connected to the tube-passageway of a heat-exchanger (not shown in the drawing) for heat-exchanging of the heat medium, thereby causing the heat medium to circulate within the jacket 2, while, at the upper end side of each of the multitude of thus arranged tubes 1, 1, . . . , there are communicatively connected a duct 3 of a vacuum exhaust system, equipped with a vacuum pump or a cold-trap 30; and, at the lower end side of each of the tubes 1, 1, . . . , there are provided an opening-and-closing valve V to hermetically close the tubes, and a recovery chamber 4 below the valve V by connecting the same to the lower surface side of the jacket 2. Within the duct 3 which communicates with the upper end side of each of the tubes 1, 1, . . . , there is disposed a distributive ejection head 7 connected to the downstream side of the abovementioned tube passageway 5, to which distributive ejection nozzles 70, 70, . . . corresponding to each of the tubes 1, 1, . . . , are provided. With these distributive ejection nozzles 70, 70, . . . , the liquid material is distributively fed into the inner cavity of each of the tubes 1, 1, . . . , thereby freezing the liquid material onto the inner wall surface 1*a* of each of the tubes 1, 1, . . . , which has been kept cooled by the heat medium within the jacket 2. As soon as the frozen layer reaches a predetermined thickness, the liquid material, which is flowing down in its unfrozen state, is drawn outside through a take-out tube 6 disposed on one part of the upper surface side of the valve V and at the lower end side of the tubes 1, 1, . . . , whereby the liquid material is frozen in the columnar shape having a predetermined thickness on the inner wall surface of each of the tubes 1, 1, . . . This frozen columnar material on the inner wall surface of the tubes is maintained under the vacuum condition by means of a vacuum exhaust system, which is communicated with the duct 3, to cause the water content to be sublimated from this frozen liquid material for its freeze-drying. As soon as the frozen material is completely desiccated, the valve V is opened and the dried product of the liquid material, as desiccated in its columnar shape, is dropped into the recovery chamber 4 as the desiccated bulk, and is taken outside.

The conventional means for adjusting the abovementioned material for foodstuffs, medicaments, and so forth into liquid form, and then freeze-drying the thus adjusted liquid material necessitates installation of a facility for prevention of contamination, careful operations of the facility, and care-taking in its maintenance, in one means of a type, wherein the liquid material is distributively fed into vessels (or containers), then the liquid material together with the container is placed in a desiccating chamber of the freeze-drying apparatus, and subjecting the material to freeze-drying under the vacuum condition, in the course of distributively feeding the liquid material as adjusted into the vessels, and of placing these vessels filled therein with the liquid material into the desiccating chamber of the freeze-drying apparatus, the working and operations of which are complicated and troublesome, hence problems exist in many aspects such as guarantee of sterilization in the facility, prevention of the facility from risk of contamination, and others.

In the other means of a type, wherein the freeze-drying of the liquid material is carried out by use of the freeze-drying apparatus, in which the desiccating chamber is constructed with upright cylindrical tubes, the liquid material to be frozen onto the inner wall surface of the tubes by distributive feeding of the liquid material into the upright cylindrical tubes is subjected to desiccation at a uniform rate by vacuum sublimation, between the upper end side of the tube and its lower end side, on account of which the liquid material needs to be frozen onto the inner wall surface of the tube in the shape, wherein the axial part thereof takes a hollow cylindrical shape. On account of this, the liquid material should be distributively fed to the inner wall surface of the tube so as to attain substantially uniform thickness over its entire surface, which gives rise to difficult problems.

Also, if and when the liquid material is fed by ejection against the inner wall surface of the tube 1, through the distributive ejection nozzles, and, if and when the outer peripheral surface thereof comes into contact with the inner wall surface 1*a* of the tube 1 which has been kept cooled by the heat medium within the jacket 2, the liquid material is instantaneously frozen, and, since the liquid material which is ejected consecutively becomes frozen sequentially over the frozen layer of the liquid material which has been kept frozen, if and when there exists irregular distribution of the liquid material at the time of its ejection from the distributive ejection nozzle 50, the irregularity in the liquid material as ejected is amplified with increase in the layer thickness of the frozen layer, which sequentially develops into a thick laminated layer to inevitably become an irregular frozen layer to cause serious problem.

SUMMARY OF THE INVENTION

The present invention has been made with a view to solving the problems inherent in the conventional means, and to providing improved means for carrying out freezing of the liquid material onto the inner wall surface of the tube, which material was adjusted from the starting materials for foodstuffs, medicaments, etc., using a freeze-drying apparatus of a type, wherein the desiccating chamber is constructed with upright cylindrical tubes, and then the moisture content in the material is sublimated under the vacuum to be freeze-dried, when the distributive ejection of the liquid material to the tube is made in such a manner that the liquid material is fed onto the overall surface of the inner wall surface of the tube to a substantially uniform thickness.

As the means for attaining the abovementioned objective, the present invention provides means of a construction, as illustrated in FIG. 2 of the accompanying drawing, in which a cylindrical wall a, projecting upwardly of a jacket 2 for circulation of heat medium, which is disposed on the outer periphery of the upright cylindrical tube 1, is provided on the upper end side of the tube 1 to be equipped in the freeze-drying apparatus w, in a configuration wherein the peripheral wall of the tube 1 is extended; then, the liquid material is sprayed from the distributive ejection nozzle 70, which is disposed at the downstream side of the tube passageway 5 for supplying the liquid material, to the inner wall surface of the cylindrical wall a in a state of its being rendered uniform in the circumferential direction on and along the inner wall surface of the cylindrical wall a, in which condition the liquid material flows down along the inner surface of the cylindrical wall a to secure good flowing on the inner wall surface 1*a* of the tube 1, which constitutes the freezing surface of the liquid material.

With this expedient, the liquid material ejected from the distributive ejection nozzle 70 is forced out against the inner surface of the cylindrical wall a, which is so provided as to be extended upward from the upper edge of the tube 1, and which assumes a state such that the outer peripheral surface of the tube does not come into contact with the heat medium within the jacket 2. At this location, the liquid material, in its unfrozen condition, is spread in the form of film, along the inner surface of the cylindrical wall a, in which state the liquid material flows down on and along the inner surface of the cylindrical wall a, and tends to flow onto the inner wall surface of the tube 1. As the consequence, the liquid material is fed to the inner wall surface 1*a* of the tube 1, on which the frozen layer of the liquid material is formed, in the state of its being made flat and smooth in its circumferential direction, and becomes sequentially frozen onto the inner wall surface 1*a* of the tube from its upper end side toward its lower end side.

At this time, since the liquid material which tends to flow onto the inner wall surface 1*a* of the tube 1 from its upper edge side is kept at a certain predetermined temperature, there is no possibility of the liquid material to gather at the upper end position of the inner wall surface 1*a*, which constitutes the inlet part, to freeze, but, owing to the liquid material being gradually cooled in the course of its flowing down on and along the inner wall surface 1*a* of the tube 1, such liquid material becomes gradually frozen over the entire surface of the inner wall surface 1*a* with a uniform thickness throughout.

However, progress in the cooling of the liquid material during its flowing down would increase the rate of freezing of the liquid material onto the inner wall surface 1*a* of the tube 1, whereby thickness of the frozen layer of the liquid material at the lower end side of its inner wall surface 1*a* tends to increase its thickness. Therefore, measures are taken to avoid such undesirable increase in thickness, such that the jacket 2 surrounding the outer periphery of the tube 1 is defined in a plurality of numbers on both up-side and down-side of the tube, and temperature of the heat medium to be circulated within the jacket 2 is controlled individually so as to become gradually higher, between a position corresponding to the upper side of the inner wall surface 1*a* of the tube 1 and a position corresponding to the lower side thereof.

In the next place, as an expedient which has been developed from the abovementioned means, the present invention provides means as shown in FIG. 3, wherein the cylindrical wall a, which is so provided as to be extended upward from the upper edge of the tube 1, is formed in a funnel-shaped slant wall b, with its diameter being gradually increased upward, and with the liquid material to be ejected from the distributive ejection nozzle 70 being blown against the part which is closer to the upper end side of this funnel-shaped slant wall b. In this way, the liquid material sputtered onto the inner surface of the cylindrical wall a with an inclined wall b, and made in a uniform thin film, gradually flows down to the reduced diameter part of the inclined wall b, whereby the liquid material is concentrated in the circumferential direction in the state of its being rendered uniform with increased thickness, while it flows onto the inner wall surface 1*a* of the tube 1.

Since this means is capable of increasing the flow-rate of the liquid material which flows onto the inner wall surface 1*a* of the tube 1 by being rendered uniform with the inner surface of the cylindrical wall a, it facilitates control for freezing the liquid material as the frozen layer having a substantially uniform thickness over the entire surface of the inner wall surface 1*a*.

Further, as a means which has been much developed from the means, in which the abovementioned cylindrical wall a is made into a funnel-shaped slant wall b, the present invention provides means, as shown in FIG. 4, in which the cylindrical wall a is formed in a hopper-shape, wherein an upright wall c in a rectilinear cylindrical form rises from the upper edge of the inclined wall b, and the liquid material to be ejected from the distributive ejection nozzle 70 is sputtered against the inner surface of the upright wall c of this hopper-shaped cylindrical wall a. The liquid material as ejected is made into a thin film by the inner surface of this upright wall c, which is concentrated by the funnel-shaped slant wall b to flow onto the inner wall surface 1*a* of the tube 1.

With this means, even when the quantity of the liquid material to be ejected from the distributive ejection nozzle 70 is increased, such liquid material is made uniform by the upright wall c having a wide area, and is concentrated by the funnel-shaped slant wall b to flow into the tube 1.

Various objects of the present invention as described above will become more apparent and understandable from the following detailed explanations thereof, when read in conjunction with the specific embodiments thereof as shown in the accompanying drawing.

BRIEF EXPLANATIONS OF THE ACCOMPANYING DRAWING

DETAILED DESCRIPTION OF PREFERRED EMBODIMENTS

Figure 1:
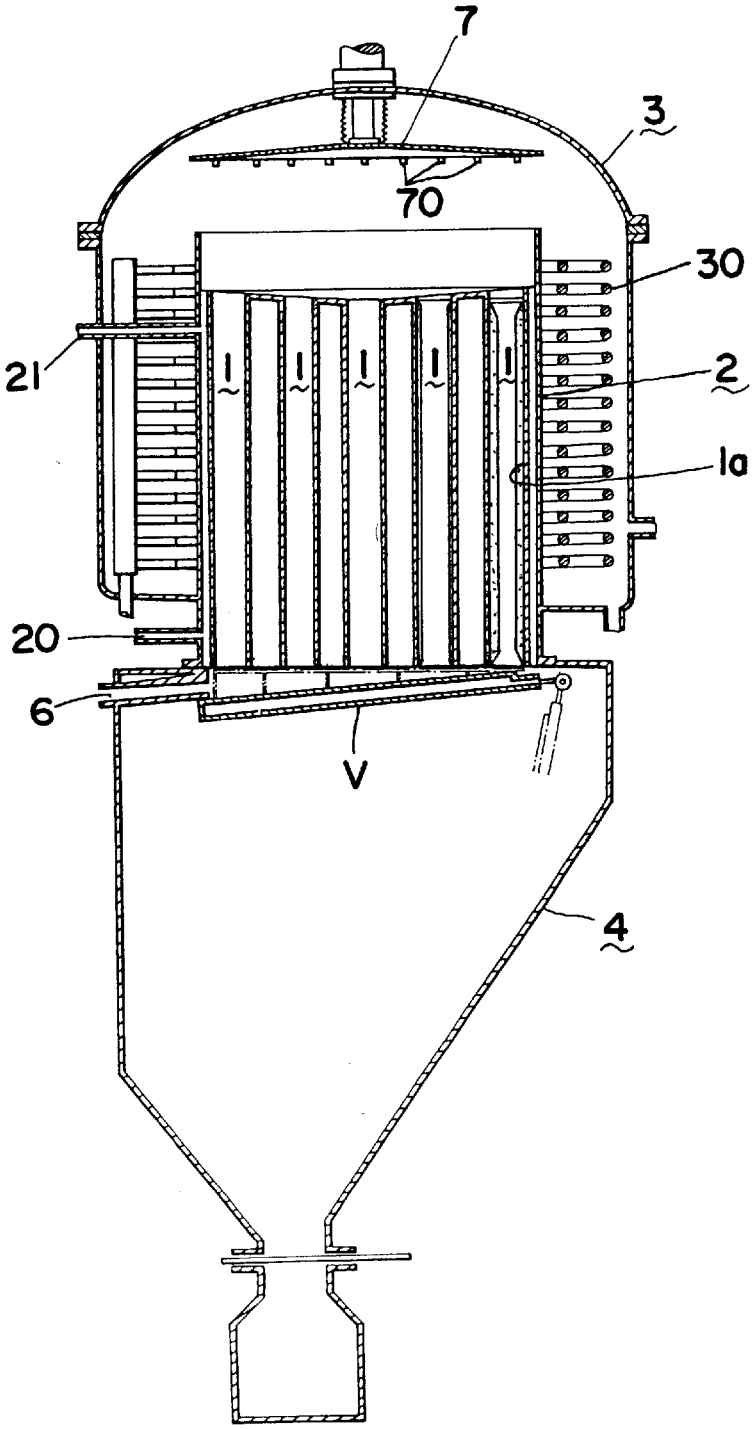
FIG. 1 is a front view, in longitudinal cross-section, showing the main part of a conventional freeze-drying apparatus of a configuration, in which the liquid material is made to freeze on the inner wall surface of an upright cylindrical tube for freeze-drying the same.
Figure 2:
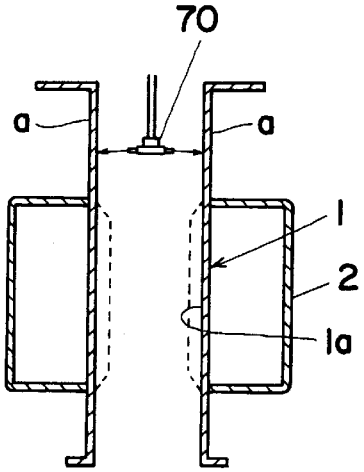
FIG. 2 is a schematic view, in longitudinal cross-section, for explaining the distributive ejection apparatus in the freeze-drying apparatus by use of an expedient, according to the present invention.
Figure 3:
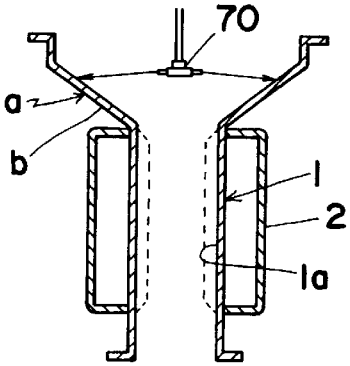
FIG. 3 is a schematic view, in longitudinal cross-section, for explaining another embodiment of the distributive ejection apparatus according to the present invention.
Figure 4:
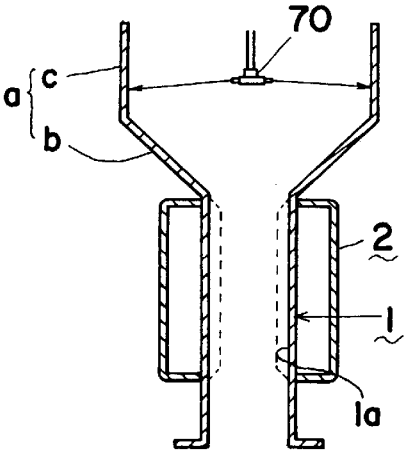
FIG. 4 is a schematic view, in longitudinal cross-section, for explaining other embodiment of the distributive ejection apparatus according to the present invention.

In the following, the present invention will be described in more detail with reference to several preferred embodiments thereof as illustrated in the accompanying drawing.

The distributive ejection device of the liquid material in the freeze-drying apparatus for the production of foodstuffs, medicaments, and so on, according to the present invention is constructed in the following manner. First of all, as shown in FIG. 5, the desiccating chamber for freeze-drying the liquid material of foodstuffs, medicaments, etc., as frozen, in the freeze-drying apparatus, on which the distributive ejection device is to be equipped, by sublimation of the moisture content in such material, is formed of the upright cylindrical tube 1, on the inner wall surface of which the liquid material is to be frozen; then, a jacket 2 for circulating therewithin the heat medium for cooling the tube 1 is provided on the outer periphery of the tube 1 in an outer cylindrical form so as to surround the tube; subsequently, an inlet pipe 20 and an outlet pipe 21 to be equipped on this jacket are connected to a tube passageway f for a heat-exchanger e and a heating device h to be controlled by the operation of a refrigerator d, through which the heat medium is circulated; on one hand, on the upper end side of the tube 1, there is communicatively connected, by way of a valve 30, a duct 3 to a vacuum exhaust system equipped with a vacuum pump and a cold-trap; while, on the other hand, on the lower end side of the tube 1, there is provided a valve in a freely openable and closable manner, or there is connected a recovery chamber 4 with a valve V2 being equipped on the bottom part of the tube; and, into this duct 3, there is introduced the end part of the lower end side of the tube passageway 5, through which the liquid material is supplied, to the end part of which the distributive ejection head 7 is provided to constitute the feeding port for supplying the liquid material into the tube 1, the liquid material to be fed from the distributive ejection nozzle 70 defined in the distributive ejection head being frozen on the inner wall surface 1*a* of the tube 1, followed by sublimation of the moisture content in the material, under the vacuum condition, thereby freeze-drying the material within the tube 1 into the intended product.

In this freeze-drying apparatus of the type, in which the desiccating chamber is constructed with the upright cylindrical tube 1, there is provided a cylindrical wall a, on the upper edge of the tube 1, in a manner to rise upwardly to a level higher than the liquid surface of the heat medium to be circulated within the jacket 2 surrounding the tube 1, so as to extend the peripheral wall of the tube 1 in the upward direction. On the other hand, the distributive ejection head 7 to be disposed within the duct 3 is so made that the liquid material ejected from the distributive ejection nozzle 70 of the head 7 is sputtered against the inner surface of this cylindrical wall a, and made into a thin film of uniform thickness by the inner surface of this cylindrical wall a, in which state the liquid material flows down on and along the cylindrical wall a, and thus flows further down onto the inner wall surface 1*a* of the tube 1 which has been kept cooled in contact with the head medium.

Figure 5:
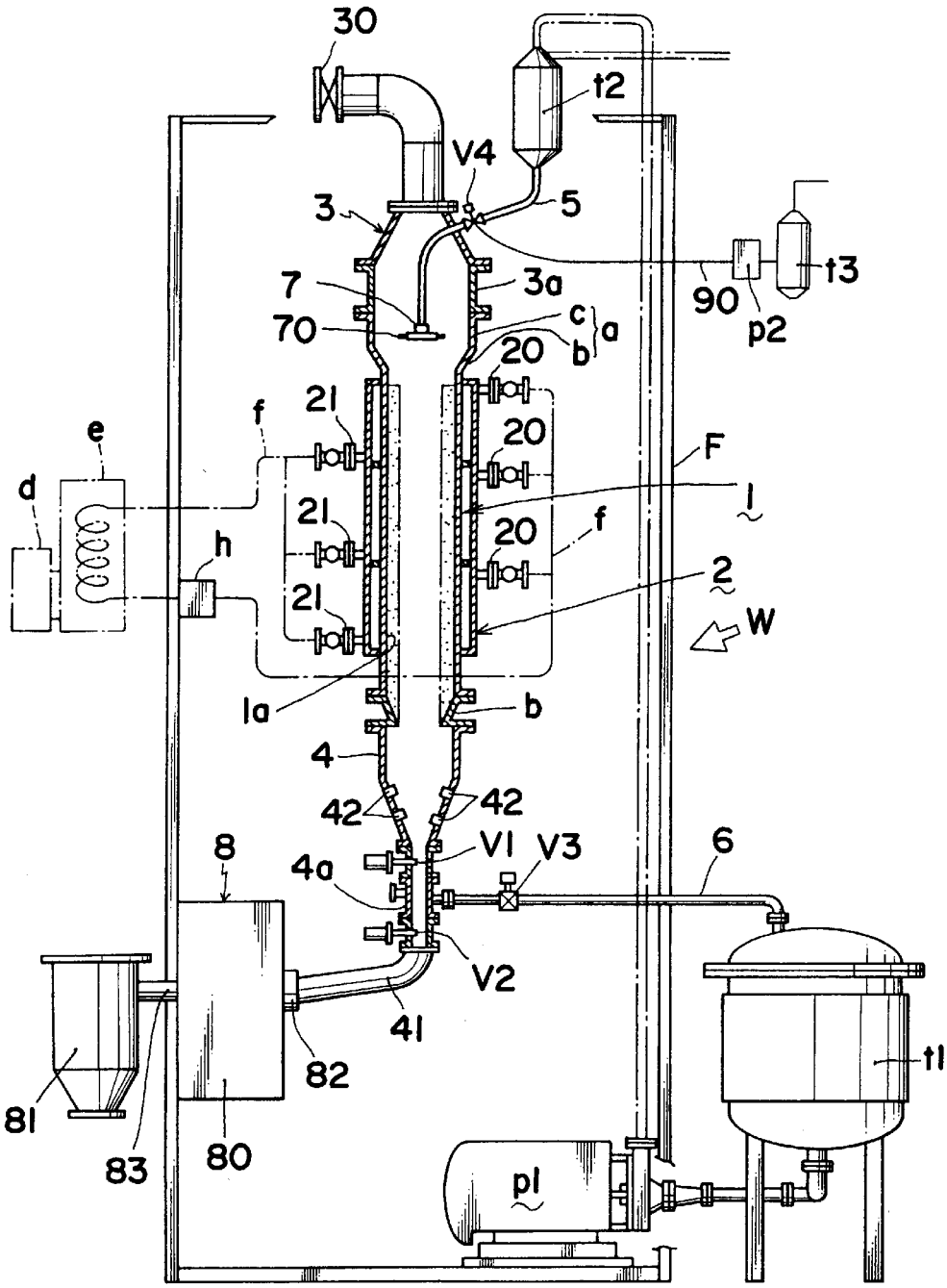
FIG. 5 is a schematic side elevational view, partly in longitudinal cross-section, of one embodiment of the freeze-drying apparatus, in which the expedient according to the present invention is put into practice.

In the above-described embodiment shown in FIG. 5, this cylindrical wall a is formed in a rectilinear cylindrical shape with the peripheral wall of the tube 1 being extended upward. As illustrated in the embodiment shown in FIG. 6, however, this cylindrical wall is made in hopper-shape, in which the upright wall c in the rectilinear cylindrical shape having a larger diameter than that of the tube 1 is continuous to the upper end side of the funnel-shaped slant wall b, the diameter of which gradually widens upward from the upper edge of the peripheral wall of the tube 1. With this construction, the liquid material ejected from the nozzle 70 of the distributive ejection head 7 disposed within the duct 3 is sputtered against the inner surface of the upright wall c of the hopper-shaped cylindrical wall a, whereby it is spread in a thin film form. From this state of the thin film form having a uniform thickness, the liquid material is collected in the circumferential direction during its flow-down movement on and along the funnel-shaped slant wall b, so that it may flow onto the inner wall surface 1*a* to constitute the freezing surface of the tube 1.

The impinging position of the liquid material ejected from the distributive ejection nozzle 70 onto the inner surface of the cylindrical wall a is so selected that it corresponds to the upper edge portion of the funnel-shaped slant wall b, whereby the slant wall b may perform its dual functions of causing the liquid material ejected from the distributive ejection nozzle 70 to have a uniform film thickness, and of collecting the liquid material thus rendered uniform in film thickness, thereby making the upright wall c in the rectilinear cylindrical form, which is continuous to the upper end side of the slant wall b, to be the connecting part with the duct 3.

Moreover, the connection of the duct 3 to the upper end side of this tube 1 may be done in accordance with the embodiment shown in FIG. 5, wherein the cylindrical wall a and the duct 3 are connected by interposing a spacer-shaped auxiliary duct 3*a* for connection between the upper end side of the hopper-shaped cylindrical wall a provided to extend upwardly the upper end side of the tube 1 and the lower end side of the duct 3. This expedient is particularly advantageous in that sufficient space can be taken for disposing the distributive ejection head 7 within the duct 3, when the duct 3 is to be communicatively connected with the inner cavity of the tube 1 by connection of the duct 3 with the upper end side of the tube 1.

Figure 11:
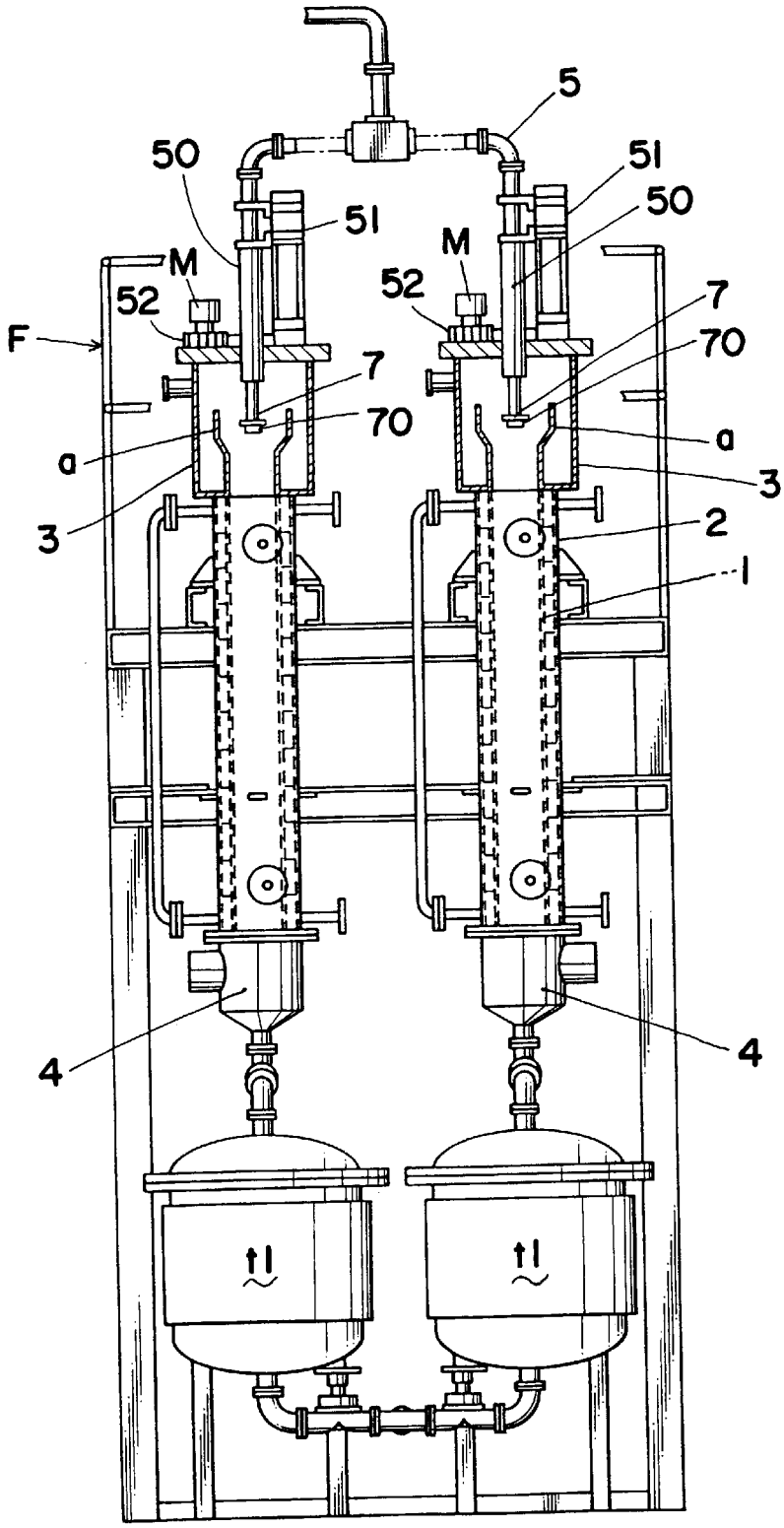
FIG. 11 is a side view, partly in longitudinal cross-section, of another embodiment of the freeze-drying apparatus, in which the expedient according to the present invention is incorporated.

In addition, the communicative connection of the duct 3 with the upper end side of this tube 1 may be done in such a manner that, as shown in FIG. 11, a junction part is provided in a partition wall to close the upper surface side of the jacket 2, to which the lower end side of the duct 3 is connected, and the cylindrical wall a to be provided at the upper end side of the tube 1 for its upward extension may pass through the abovementioned partition wall and thrust into the duct 3, thereby assuming a state of the inner cavity of the tube 1 being communicatively connected with the interior of the duct 3.

Further, in the case of the tube 1 being juxtaposed in a plurality of numbers, as in the conventional expedient as explained in the afore-described embodiment of FIG. 1, and each of the tubes 1, 1, . . . being disposed within the vessel- or bucket-shaped jacket 2 in a manner to be dipped therein, the duct 3 may be formed in the shape of an umbrella or a bowl to surround the upper part of each of the juxtaposed tubes 1, 1, . . . , and be connected to the upper edge of the jacket 2. Even in this case, the distributive ejection of the liquid material to each tube 1 is effected for each individual tube 1 by providing the distributive ejection nozzle 70, in correspondence to each of the cylindrical wall a to be disposed for each and every tube 1.

Figure 8:
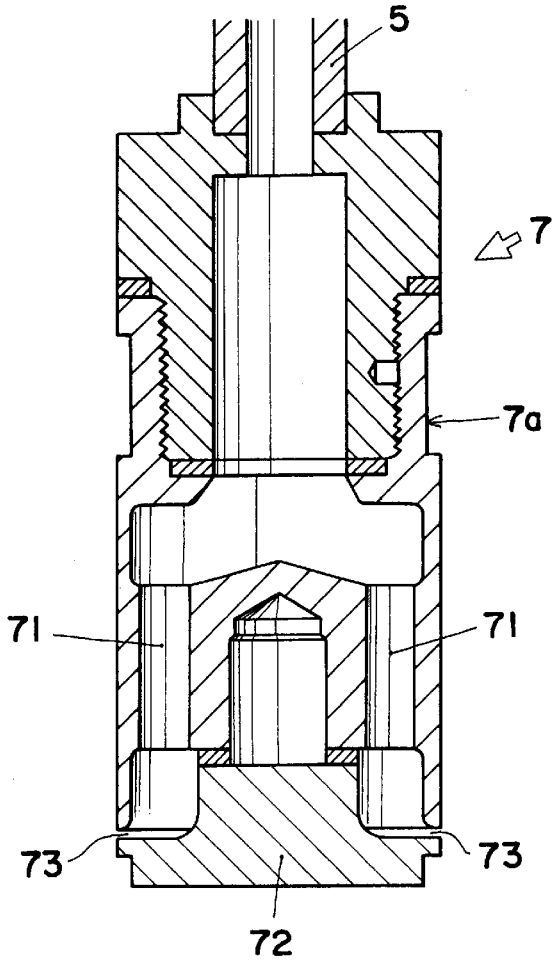
FIG. 8 is a longitudinal cross-section of the distributive ejection head to be used in the distributive ejection apparatus according to the present invention.
Figure 9:
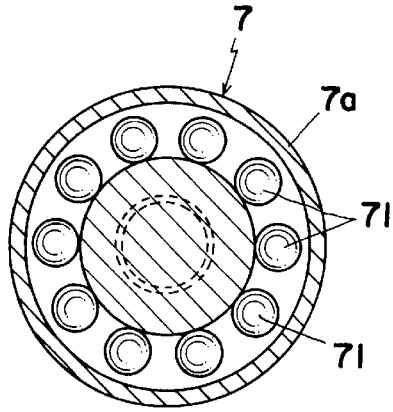
FIG. 9 is a cross-sectional view of a distributive ejection head, same as above, according to the present invention.
Figure 10:
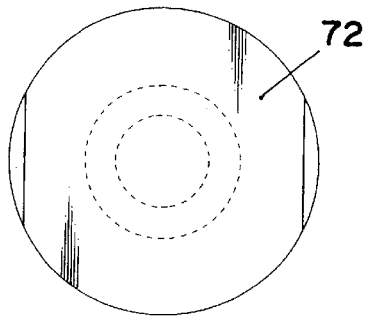
FIG. 10 is a bottom view of the distributive ejection head, same as that shown in FIG. 9 above.

While the distributive ejection head 7 to be disposed within the duct 3 so as to eject the liquid material onto the inner surface of the cylindrical wall a may also be such that the liquid material is ejected from the distributive ejection nozzles 70, 70, . . . over the entire range of the cylindrical wall a in the circumferential direction of its inner surface, by disposing a multitude of distributive ejection nozzles 70, 70, . . . in an annular arrangement in the distributive ejection head 7 to be provided at the end part of the downstream side of the tube passageway 5 which has been introduced into the duct 3, it may also be feasible that the body 7*a* of the distributive ejection head 7 to be provided at the end part of the downstream side of the tube passageway 5 is formed in a concentric cylindrical form as shown in FIGS. 8, 9, and 10 so as to dispose the flow paths 71 in an annular arrangement, each being of a small diameter and extending in the up-and-down direction; then, a bottom piece 72 is placed on the bottom surface side of this body 7*a* in the concentric cylindrical form to clog the bottom end of the body by plugging and screwing the center position of the upper surface side of this bottom end piece into the axial part of this body 7*a*, in such a way that the bottom piece 72 may be connected to the body 7*a* in a freely adjustable manner in the up-and-down direction of the body 7*a*; and finally, an annularly continuous slit 73 is formed between the peripheral edge of the upper surface of the bottom piece 72 and the lower edge of the circumferential wall of the body 7*a* so that the liquid material to be introduced into the distributive ejection head 7 from the tube passageway 5 is divided into a multitude of small-diameter flow paths 71, which are disposed in an annular form within the body 7*a*, and impinges on the upper surface of the bottom piece 72, from the upper surface of which the liquid material passes through the annular slits 73 and is ejected in all the circumferential directions of the distributive ejection head 7.

Figure 6:
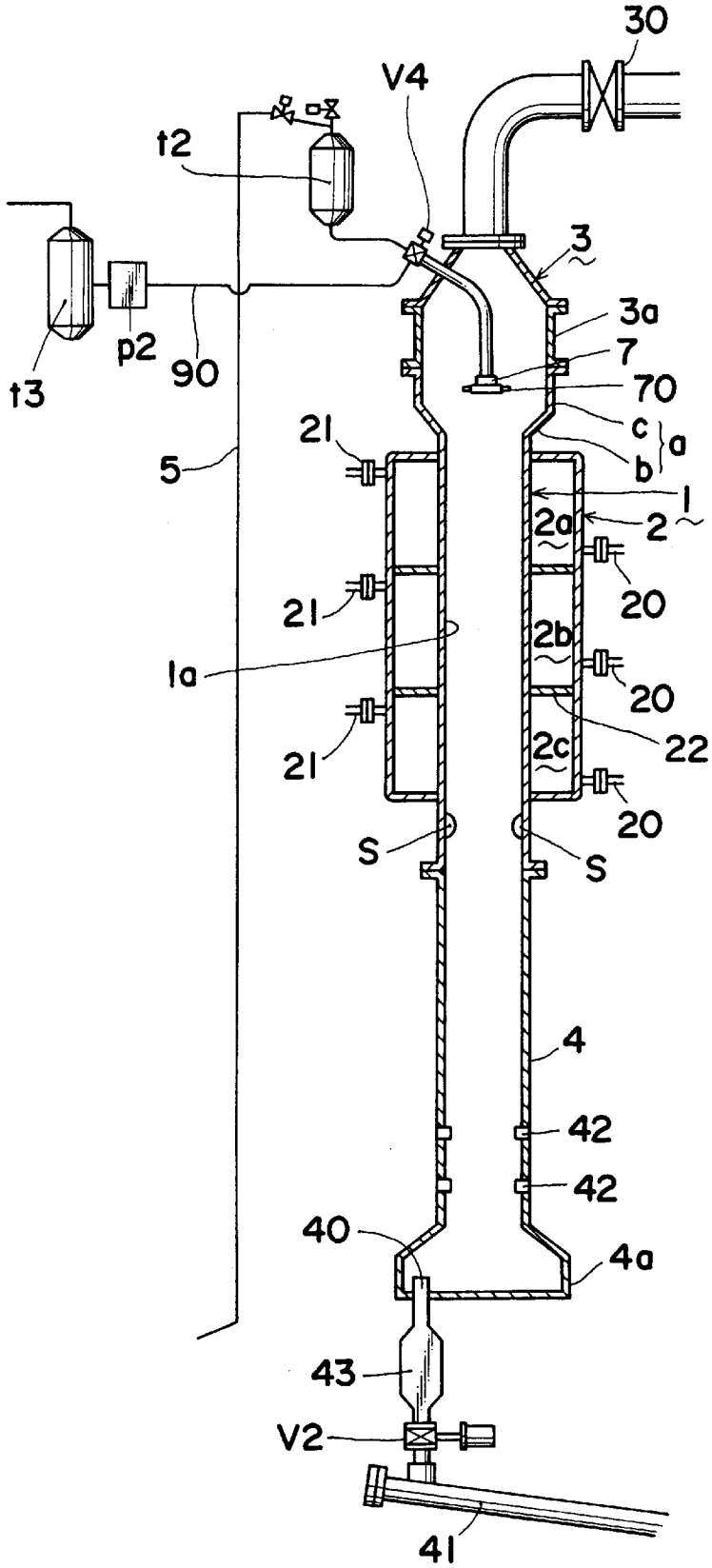
FIG. 6 is a side elevational view, partly in longitudinal cross-section, of another embodiment of the freeze-drying apparatus according to the present invention.
Figure 7:
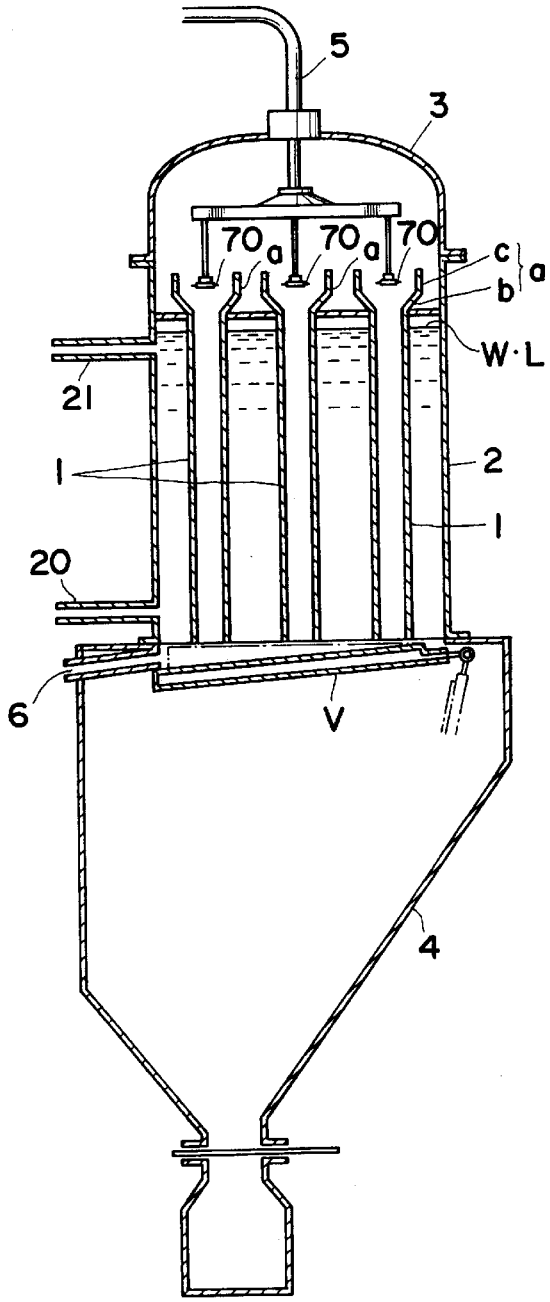
FIG. 7 is a longitudinal cross-sectional view of still other embodiment of the freeze-drying apparatus according to the present invention.

Furthermore, when the liquid material is to be sprayed in its atomized form onto the inner wall surface 1*a* of the tube 1, this distributive ejection head 7, in advance of freezing of the liquid material, applies distilled water in its atomized form onto the inner wall surface 1*a* of the tube 1 (which is the means invented by the present applicants) to cause it to freeze in a thin film form, thereby applying an 'ice-lining'. Over this ice-lining, the liquid material is made to freeze, thereby effecting quick freezing of the liquid material onto the inner wall surface 1*a* of the tube 1. After desiccation of the liquid material, if and when the peeling of the desiccated layer of the material from the inner wall surface 1*a* of the tube 1 is to be done easily, this distributive ejection head 7 is connected, in a freely changeable manner through a change-over valve V4, as shown in FIGS. 5 and 6, to both tube passageway 5 for introducing the liquid material, and a conduit pipe 90 to lead distilled water which is sent out of the distilled water tank t3 by means of a pump p2, whereby it becomes possible to co-use the distilled water atomizing nozzle for the formation of the 'ice-lining'. Such construction is also feasible.

Also, at the time of, and, prior to, freezing the liquid material on the inner wall surface 1*a* of the tube 1, a device for maintaining distilled water, on the inner wall surface 1*a* of the tube, in its thinly frozen film form, can be dispensed with, in some case, by coating a Teflon(trademark) type synthetic resin material over the inner wall surface 1*a* of the tube 1. In that case, the liquid material ejected from the distributive ejection head 7 is made to be directly fed onto the inner wall surface of the tube 1, which has been subjected to this synthetic resin coating.

In addition, the distributive ejection head 7 to be connectively provided at the terminal part to the downstream side of the tube passageway 5, is constructed in such a manner that, as an example illustrated by FIG. 11, a telescopic part 50, which can be extended and retracted in the vertical direction, is provided at the downstream side of the tube passageway 5, to which telescopic portion is connected a lifting or elevating mechanism 51 moving in the vertical direction (such as cylinder, etc. provided on the upper surface side of the duct 3) By the operations of this lifting or elevating mechanism 51, the distributive ejection head 7 moves up and down, whereby the ejecting position of the liquid material against the inner surface of the cylindrical wall a from the nozzles 70 defined in the distributive ejection head 7 displaces in the up-and-down direction with respect to the inner surface of the cylindrical wall a. Moreover, this terminal part at the downstream side of the tube passageway 5 is constructed in a freely rotatable manner with the axial line thereof as its center, on which the duct 3 is pivotally supported, and, with which is connected a rotary mechanism 52 to be mounted on the upper surface side of the duct 3. By actuation of the rotary mechanism 52 with a motor M, etc., the distributive ejection head 7 performs its gyratory motion.

In the embodiment shown in the drawing, a reference letter F designates a machine frame placed at a desired location for mounting the main body part of the freeze-drying apparatus, constructed with the upright cylindrical tubes 1, the jacket 2 provided on and around the outer periphery of the tube, and the duct 3 to be connectingly provided on the upper end side of the tube, as described in the foregoing.

A reference letter t1 denotes a recovery tank for getting back unfrozen liquid material to be taken from the take-out tube 6, when the liquid material is distributively ejected into the tube 1 from the distributive ejection head 7 and then is caused to freeze on the inner wall surface 1*a* thereof in a cylindrical shape. A suction pump p1 is connected to the bottom part of the recovery tank, with which the unfrozen liquid material as recovered through this take-out tube 6 is pumped up into the second tank t2 which is positioned above the duct 3, and fittingly mounted on the machine frame F. From this tank t2, the unfrozen liquid material is again fed into the distributive ejection head 7.

In the embodiment shown in FIG. 6, reference numerals 2*a*, 2*b*, and 2*c* designate segments which are defined by partitioning the inner cavity of the outer cylindrical jacket 2 surrounding the tube 1, with partitioning walls 22, 22, . . . set on end-to-end relationship. The heat medium to be circulated within the jacket 2 is made feedable for each and every segment upon its temperature control, by connecting the inlet tube 20 and the outlet tube 21 equipped on each of the segments 2*a*, 2*b*, and 2*c*, with the heat exchanger 2*b* being equipped on each of the segments 2*a*, 2*b*, and 2*c*. In this way, the cooling temperature, with the heat medium, of the inner wall surface 1*a* of the tube 1 to be the freezing surface for freezing the liquid material, is controlled: for example, at the lowest level of the position corresponding to the segment 2*a* on the upper part; at a slightly higher level of the position corresponding to the segment 2*b* on the middle part; and at the highest level of the position corresponding to the segment 2*c* on the lower part. Thus, the liquid material ejected from the distributive ejection nozzle 70 in its state of not being cooled and flowing on and along the inner surface of the cylindrical wall a, and down toward the inner wall surface 1*a* of the tube 1 comes into contact with the inner wall surface 1*a*, which has been kept cooled, to be gradually cooled, whereby the rate of freezing of the liquid material onto the inner wall surface 1*a* becomes faster. As the consequence, it becomes possible that the liquid material becomes able to freeze, as the frozen layer of a uniform thickness, on the entire inner wall surface 1*a*, which, according to the conventional means, much of the liquid material had a tendency of freezing onto the lower end side of the inner wall surface 1*a*.

A reference letter S in FIG. 6 designates a holding member disposed on the inner wall surface 1*a* of the tube 1 for preventing the desiccated bulk of the liquid material, which has completed its desiccation, from dropping off the tube 1, when the moisture content in the liquid material, as frozen on the inner wall surface of the tube, is to be sublimated for desiccation of the material. These holding members S are protrudingly disposed toward the inner cavity of the tube 1, at a position below the jacket 2 and at the lower end part of the inner wall surface 1*a* of the tube 1, with which holding members the lower edge of the desiccated bulk of the liquid material is stopped so as to be held at this position.

This holding member S is so disposed that it may protrude from the inner wall surface 1*a* of the tube 1 toward the inner cavity thereof, and, as soon as the liquid material is completely desiccated, the holding member is retracted inward of the inner wall surface 1*a*, whereby the protruded holding member comes off the desiccated bulk of the liquid material which it has held, to permit the desiccated bulk of the liquid material to drop into the recovery chamber 4 which is connectively provided to the lower end side of the tube 1. Or else, the surface of the holding member is made slantendicular, and, as soon as the desiccation of the liquid material is completed, pressurized air is sent downward from the upper end side of the tube 1 to grind the desiccated bulk of the material under pressure. In this manner, the desiccated bulk overrides the holding member S to drop into the recovery chamber 4.

A reference numeral 8 (in FIG. 5) designates a comminuting apparatus for grinding the liquid material which has already been desiccated and dropped into the recovery chamber 4, the crushing apparatus being of an ordinary type, equipped with a power mill/jet mill within the machine body 80. A material intake port 82 defined in the machine body 80 is communicatively connected, through a conveying tube 41, with an exhaust port 40 being provided in the bottom part of the recovery chamber 4 so as to be opened and closed by a valve V2. The desiccated bulk of the liquid material which is air-borne and conveyed from the exhaust port 40, through the conveying tube 41, is crushed by the power mill/jet mill installed in the machine body 80. A centrifugal cyclone separator 81 is connected to an outlet port 83 for separating the crushed product to be taken out of the outlet port 83 into air and the crushed product.

A reference numeral 42 designates jet nozzles disposed on the inner surface side of the peripheral wall of the recovery chamber 4 for subjecting the desiccated bulk of the liquid material, as recovered within the recovery chamber 4, to the crushing treatment, before it is discharged from a discharge port. The jet nozzles are positioned within the recovery chamber 4 in a manner to induce gyratory current, with the axial part of each jet nozzle being made as its center. By the jet current of air to be ejected from these jet nozzles 42, 42, . . . , the liquid material dropping into the recovery chamber 4 is crushed.

The recovery chamber 4 is formed in the cylindrical shape of a length and a volume capable of accommodating the liquid material which has completed its drying in the tube 1, even if such liquid material drops into this recovery chamber 4 in its cylindrical shape conforming to the shape of the inner wall surface 1*a* of the tube 1. Its bottom part, however, is shaped in an enlarged diameter part 4*a*, with its diameter being made larger than the tube 1 and the main body part of the recovery chamber 4, as shown in FIG. 6, in order not to cause clogging of the bottom part, when the liquid material drops down, at one time, in its cylindrical shape to heap up in the form of crushed product. Then, a discharge port 40 is formed in this bottom plate part, at a position which is off-sided from the position beneath the main body part of the recovery chamber 4, and an exhaust pipe 43 is connected to this exhaust port 40, the lower mouth of the discharge tube being communicatively connected with the conveying tube 41 through the valve V2.

Also, if and when the desiccated bulk of the liquid material is brittle in its property, hence comminution of the desiccated bulk of the liquid material can be done perfectly with a jet nozzle 42 disposed within this recovery chamber 4, the comminuting apparatus 8 may be dispensed with, and a cyclone separator 82 may be connected to the downstream side of the conveying tube 41.

As has so far been explained in detail in the foregoing, the distributive ejection apparatus of liquid material, installed in the freeze-drying apparatus for foodstuffs, medicaments, and so forth, according to the present invention, is of such a construction that the feeding of the liquid material into the inner cavity of the upright cylindrical tube to be equipped in the freeze-drying apparatus is done by providing the cylindrical wall rising upward higher than the jacket surrounding the outer periphery of the tube on the upper end side thereof, in a manner to extend the same upwardly, followed by sputtering the liquid material as ejected from the distributive ejection nozzle against the inner surface of this cylindrical wall, thereby rendering the film thickness of the liquid material to be uniform in the circumferential direction of the tube so as to enable it to flow onto and spread over the inner wall surface of the tube constituting the freezing surface. In this way, the liquid material can be adequately and efficiently spread over the entire inner wall surface of the tube, as the frozen layer in a hollow cylindrical shape, and having a substantially uniform layer thickness. As the consequence, sublimation of the moisture content in the liquid material, as frozen, becomes able to be done at a uniform rate in the span of from the upper end side to the lower end side of the inner wall surface of the tube.

Although, in the foregoing, the present invention has been described in detail in reference to the accompanying drawing representing specific preferred embodiments thereof, it should be noted that the invention is not limited to these embodiments alone, but any changes and modifications in the structure of the freeze-drying apparatus may be made by those skilled in the art within the spirit and scope of the invention as recited in the appended claims.

What is claimed is:

1. In a freeze-drying apparatus for desiccating moisture content in liquid material by its sublimation under a vacuum condition, said apparatus comprising a desiccating chamber for freeze-drying said liquid material to be charged therein, said desiccating chamber being constructed with an upright cylindrical tube; a jacket, provided on an outer periphery of said tube, to circulate heat medium on and around the outer circumference of said tube; a duct communicatively connected with a vacuum exhaust system, on an upper end side of said tube, said liquid material being frozen onto an inner wall surface of said tube, a distributive ejection device for the liquid material comprising a cylindrical wall upwardly projecting high above said jacket which surrounds the outer periphery of said tube, in a manner to elongate said cylindrical wall, at the upper end side of the upright cylindrical tube; a downstream side of a tube passageway for feeding the liquid material being introduced into the duct connected to the upper end side of said tube; a distributive ejection nozzle to eject said liquid material being positioned and disposed at the terminal part of the downstream side to enable the ejected liquid material to be blown against an inner wall surface of said cylindrical wall, thereby rendering uniform the liquid material, ejected from said distributive ejection nozzle, in the circumferential direction of said tube by the inner wall surface of said cylindrical wall to feed the liquid material to the inner wall surface of said tube.

2. The distributive ejection device for liquid material in a freeze-drying apparatus for foodstuffs, medicaments, etc. according to claim 1, wherein the cylindrical wall to be provided by upwardly projecting said jacket on the outer periphery of the tube is formed in a funnel-shaped slant wall, which gradually increases its diameter as it goes upward, and the liquid material to be sprayed onto the slant wall from said distributive ejection nozzle, and rendered uniform in the circumferential direction being concentrated in the circumferential direction, during its flow-down movement on and along the slant wall, in its state, to thereby be fed onto the inner wall surface of said tube.

3. The distributive ejection device for liquid material in a freeze-drying apparatus for foodstuffs, medicaments, etc. according to claim 1, wherein the cylindrical wall to be provided in a manner to protrude upwardly of the jacket on and around the outer periphery of said tube is formed, at the upper end side of the upright cylindrical tube, in a hopper shape, with the funnel-shaped slant wall which gradually increases its diameter as it goes upward from an upper edge of said tube, and the rectilinear cylindrical wall rising upward from the upper edge of the funnel shaped slant wall, said distributive ejection nozzle being so disposed that the liquid material elected therefrom is blown against the inner wall surface of said rectilinear cylindrical wall, whereby the liquid material blown onto the rectilinear cylindrical wall is fed onto the inner wall surface of the tube on and along said slant wall.

4. The distributive ejection device for liquid material in a freeze-drying apparatus for foodstuffs, medicaments, etc. according to claim 1, wherein the distributive ejection nozzle for ejecting the liquid material by being connected to the end part of the downstream side of the tube passageway for feeding the liquid material is disposed at a center position of the cylindrical wall so as to protrude upwardly of the jacket surrounding the outer periphery of the upright cylindrical tube, at the upper end side of said tube by forming the nozzle to radially eject the liquid material in all directions with the distributive ejection nozzle as the center, said liquid material to be ejected from said distributive ejection nozzle being radially sprayed and ejected against the inner wall surface of said cylindrical wall.

5. The distributive ejection device for liquid material in a freeze-drying apparatus for foodstuffs, medicaments, etc. according to claim 1, wherein said distributive ejection nozzle to eject the liquid material is connected, in a freely changeable manner through a change-over valve, to the tube passageway for feeding the liquid material and the tube passageway for conducting distilled water, said distributive ejection nozzle being in dual use for atomizing distilled water to form an ice-lining of distilled water on the inner wall surface of the tube, prior to freezing the liquid material on the inner wall surface of the tube.

6. The distributive ejection device for liquid material in a freeze-drying apparatus for foodstuffs, medicaments, etc. according to claim 1, wherein a synthetic resin material is applied onto the inner wall surface of the tube, on which the liquid material is to be frozen, and the liquid material to be ejected from the distributive ejection nozzle being made to freeze on the inner wall surface of the tube, on which said synthetic resin material is to be coated.

7. The distributive ejection device for liquid material in a freeze-drying apparatus for foodstuffs, medicaments, etc. according to claim 1, characterized in that a telescopic part moving in the up-and-down direction is provided at the end part of the downstream side of the tube passageway for feeding the liquid material, to which the distributive ejection nozzles are connectively provided, and an elevating mechanism is connected to said telescopic part, whereby the position of ejecting the liquid material from the distributive ejection nozzle is displaced up and down by the movement of said telescopic part owing to said elevating mechanism.

8. The distributive ejection device for liquid material in a freeze-drying apparatus for foodstuffs, medicaments, etc. according to claim 7, characterized in that the telescopic part which can rotate freely in the up and down direction, with the axial line as the center to which the distributive ejection nozzle is connectively provided, thereby permitting the distributive ejection nozzle to gyrate by the movement of a rotary mechanism.

* * * * *